US009389051B2

(12) United States Patent
Langenbeck

(10) Patent No.: US 9,389,051 B2
(45) Date of Patent: Jul. 12, 2016

(54) HOLLOW TUBE PROJECTILES AND LAUNCH SYSTEMS THEREOF

(71) Applicant: Keith A. Langenbeck, Keller, TX (US)

(72) Inventor: Keith A. Langenbeck, Keller, TX (US)

( * ) Notice: Subject to any disclaimer, the term of this patent is extended or adjusted under 35 U.S.C. 154(b) by 0 days.

(21) Appl. No.: 14/636,374

(22) Filed: Mar. 3, 2015

(65) Prior Publication Data

US 2016/0010964 A1 Jan. 14, 2016

Related U.S. Application Data

(63) Continuation-in-part of application No. 14/146,224, filed on Jan. 2, 2014.

(51) Int. Cl.

| | |
|---|---|
| ***F42B 10/36*** | (2006.01) |
| ***F42B 12/02*** | (2006.01) |
| ***F42B 7/08*** | (2006.01) |

(52) U.S. Cl.

CPC . *F42B 12/02* (2013.01); *F42B 7/08* (2013.01); *F42B 10/36* (2013.01)

(58) Field of Classification Search

CPC ..... F42B 10/04; F42B 10/32; F42B 10/34; F42B 10/36

USPC ..... 446/48, 473; D21/306, 301, 441, 443, D21/444; 102/501–503, 509, 520, 524

See application file for complete search history.

(56) References Cited

U.S. PATENT DOCUMENTS

| | | | | | |
|---|---|---|---|---|---|
| 3,877,383 | A * | 4/1975 | Flatau | F42B 10/36 | 102/491 |
| 3,898,932 | A * | 8/1975 | Flatau | F42B 12/50 | 102/502 |
| 3,912,197 | A * | 10/1975 | McKown | F41G 7/26 | 102/503 |
| 3,951,070 | A * | 4/1976 | Flatau | F42B 12/50 | 102/502 |
| 3,956,844 | A * | 5/1976 | Misevich | F42B 39/00 | 102/503 |
| 3,980,023 | A * | 9/1976 | Misevich | F42B 12/50 | 102/502 |
| 3,982,489 | A * | 9/1976 | Flatau | F42B 12/745 | 102/502 |
| 4,164,904 | A * | 8/1979 | Laviolette | F42B 10/34 | 102/503 |
| 4,190,476 | A * | 2/1980 | Flatau | F42B 12/50 | 156/218 |

(Continued)

*Primary Examiner* — Jonathan C Weber

(74) *Attorney, Agent, or Firm* — Lyman Moulton, Esq.

(57) ABSTRACT

A hollow tube projectile is configured with a leading edge to first exit a firearm barrel and a trailing edge to follow there through, the hollow tube projectile comprising an annular airfoil slug. A longitudinal cross section of the annular airfoil slug resembles an airplane wing having a rounded leading edge and a sharp trailing edge and an outer lift surface there around and an inner cylindrical surface. Three or more fins are distributed equidistantly around the annular airfoil slug, each fin having an inner edge complementary to the outer lift surface and an outer edge parallel to a major axis through the annular airfoil slug. The hollow tube projectile further comprises a launch wafer comprising a metal insert adapted to contain combustion gases during launch of the annular airfoil slug. The launch wafer is adapted to receive the metal insert and concentrically position it within a hollow tube cartridge.

20 Claims, 8 Drawing Sheets

(56) References Cited

U.S. PATENT DOCUMENTS 4,262,597 A * 4/1981 Olson ..... F42B 12/50 102/502
4,301,736 A * 11/1981 Flatau ..... F42B 10/34 102/501
4,579,059 A * 4/1986 Flatau ..... F42B 10/34 102/476
4,827,847 A * 5/1989 Laviolette ..... F42B 10/54 102/501
5,970,970 A * 10/1999 Vanek ..... F42B 10/36 124/16
6,076,511 A * 6/2000 Grimm ..... F41B 7/003 124/16
6,079,398 A * 6/2000 Grimm ..... A63H 27/14 124/16
6,453,820 B1 * 9/2002 Anderson ..... F42B 10/24 102/439
6,647,890 B2 * 11/2003 Findlay ..... F41C 3/02 102/430
6,671,989 B2 * 1/2004 Vanek ..... F41A 1/00 42/18
7,500,434 B2 * 3/2009 Flatau ..... F41B 11/62 102/502
7,581,500 B2 * 9/2009 Flatau ..... F42B 12/46 102/502
7,987,790 B1 * 8/2011 Scarr ..... F42B 5/025 102/502
8,065,961 B1 * 11/2011 Scarr ..... F42B 5/045 102/503
8,511,232 B2 * 8/2013 Scarr ..... F42B 5/03 102/502
8,661,983 B1 * 3/2014 Scarr ..... F42B 10/36 102/502
2005/0066843 A1 * 3/2005 Flatau ..... F41B 11/62 102/503
2005/0183615 A1 * 8/2005 Flatau ..... F42B 12/46 102/503
2006/0096492 A1 * 5/2006 Flatau ..... F41B 11/62 102/502
2012/0180361 A1 * 7/2012 Scarr ..... F42B 5/03 42/76.01
2012/0199034 A1 * 8/2012 Gibson ..... F42B 12/40 102/502

* cited by examiner

HOLLOW TUBE PROJECTILES AND LAUNCH SYSTEMS THEREOF

CROSS-REFERENCE TO RELATED APPLICATION

This application claims the benefit of the priority date of earlier filed U.S. Provisional Patent Application Ser. No. 61/748,149, titled 'Novel Projectiles and Aerodynamic Improvements' filed Jan. 2, 2013 by Keith Langenbeck, and U.S. Non-Provisional Patent Application Ser. No. 14146224, titled 'Improvements for Hollow Tube Projectiles and Launch Systems Thereof,' filed Jan. 2, 2014 also by Keith Langenbeck, each incorporated herein by reference in its entirety.

BACKGROUND OF THE INVENTION

The field of aerodynamic design for projectiles, aircraft, rockets and the like is extensive. The physical size of small caliber bullets/projectiles presents challenges not encountered in aircraft wing, ballistic missile, artillery shell or aircraft delivered bomb design. For small caliber weapons like handguns, shotguns, rifles and machine guns, performance enhancements have for decades been incremental at best.

Hollow tube projectiles have been studied and tested since before WWI but heretofore have demonstrated inferior ballistic performance at mid-range to longer distances. Conventional hollow tube bullets exhibit inferior ballistic performance due to the air not readily passing though the tube as might be expected and results in drastically reduced ballistic efficiency. At speeds not much below Mach 2, the airflow through the hollow tube chokes itself off, increasing aerodynamic drag and reduced range of the projectile. The dramatic performance limitations caused by the choked flow problem can be understood from the Schlieren photographs found in the 2004 presentation *Performance Potential for a New Machine Gun and Ammunition Concepts* to the US Department of Defense document found at the Defense Technology Information Center web page, www.dtic.mil/ndia/2004solic/flat.ppt. Eliminating the choked flow condition and maintaining the hollow tube bullet's inherent aerodynamic efficiency across the continuum from subsonic through high Mach number velocities is unknown in the art and field of ballistics.

The difference in ballistic efficiency for the projectile diameter used in common handguns and rifles is vast. Handgun projectiles are typically designed for close range and rifles for more distant targets. The different applications affect the overall size of the weapon, bullet shape, bullet diameter, cartridge overall length, magazine capacity and projectile performance. For example, common 30 caliber bullets for handguns have a diameter from .309 to .312 inches, weigh from 80 to 110 grains and have ballistic coefficients of around .100 to .150.

Common 30 caliber bullets for rifles have a diameter from .303 to .311 inches, weigh from 110 to 220 grains and have ballistic coefficients of around .250 to .450. The lower the ballistic coefficient, the quicker the bullet loses velocity and useful range. Nose profile or shape, ratio of length to diameter, shape of the end of the projectile and other design aspects significantly affect the ballistic coefficient. Typically handgun bullets are larger in diameter than rifle bullets. The 30 caliber cartridges best illustrate the performance variations between handgun and rifle bullets of the same nominal diameter.

The Tokarev handgun cartridge from the Soviet Union, also known as the 7.62×25 mm, commonly has a bullet diameter of .309 inches, bullet length of .52 inches for a 90 grain weight, case diameter of .387 inches, cartridge overall length of 1.34 inches, muzzle velocity of 1400-1700 feet per second from a 4.5 inch barrel, ballistic coefficient of .142 and an effective range to 50 meters +/−. The well-known rifle cartridge .308 Winchester, also known as 7.62×51 mm NATO, commonly has a bullet diameter of .308 inches, bullet length of 1.15 inches for a 165 grain weight, case diameter of .470 inches, cartridge overall length of 2.81 inches, muzzle velocity of 2600-2800 feet per second from a 20 inch barrel, ballistic coefficient of .450 and an effective range of 800 meters +/−.

Trying to use lighter weight rifle bullets in a pistol application like the Tokarev results in functional compromises or are simply unworkable. Properly seating a tapered nose, longer bullet can extend the cartridge overall length beyond the physical constraints of the breech or cannibalize case capacity for the propellant needed to move the bullet at desired velocities.

There remains an unmet need in the art and in the market for a high speed ballistic projectile which eliminates the choked flow condition and maintains a hollow tube bullet's inherent aerodynamic efficiency across the continuum from subsonic through high Mach number velocities.

SUMMARY OF THE INVENTION

A hollow tube projectile is configured with a leading edge to first exit a firearm barrel and a trailing edge to follow there through, the hollow tube projectile comprising an annular airfoil body. A longitudinal cross section of the annular airfoil body resembles an airplane wing having a rounded leading edge and a sharp trailing edge and an outer lift surface there around and an inner pressure surface. Three or more fins are distributed equidistantly around the airfoil body, wherein each fin has an inner edge complementary to the outer lift surface of the body and an outer edge parallel to a major axis through the projectile.

The hollow tube projectile further comprises a launch wafer adapted to contain combustion gases during a launch of a disclosed annular airfoil slug. The launch wafer is adapted to receive a metal insert and concentrically position it within a hollow tube cartridge. A launch device is also adapted to contain combustion gases during a launch of the annular airfoil bullet and be positioned adjacent thereto, the launch device also adapted to position the annular airfoil bullet concentrically within a bore of the firearm barrel. The disclosed projectile is also known as HTS12™.

Other aspects and advantages of embodiments of the disclosure will become apparent from the following detailed description, taken in conjunction with the accompanying exemplary drawings, illustrated by way of example of the principles of the disclosure.

BRIEF DESCRIPTION OF THE DRAWINGS

FIG. 6 of the hollow tube projectile of FIG. 3 in the launch cup of FIG. 6 in accordance with an embodiment of the present disclosure.

Figure 1:
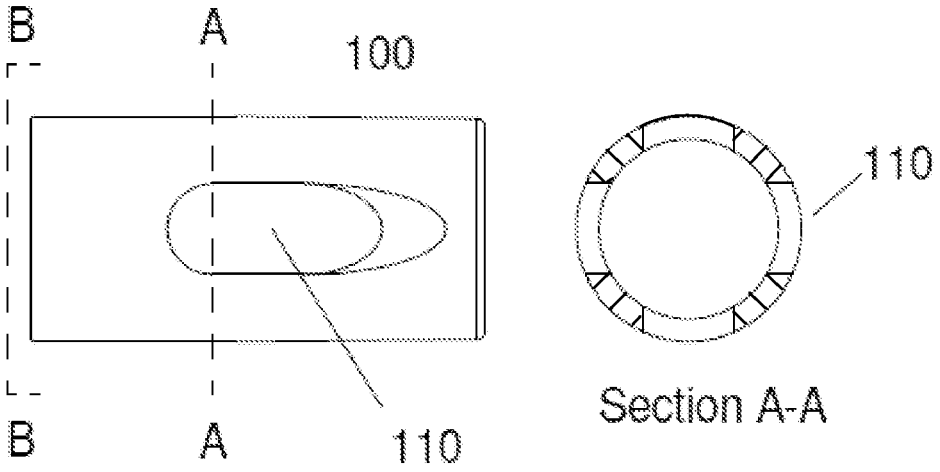
FIG. 1 depicts a top elevational view of a hollow tube projectile and a cross-section A-A through a plurality of slots therein in accordance with an embodiment of the present disclosure.

Throughout the description, similar or same reference numbers may be used to identify similar or same elements in the several embodiments and drawings. Although specific embodiments of the invention have been illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

This application discloses novel and unobvious improvements to projectile performance and launch systems in small caliber weapons but the features and performance benefits could be applied to large caliber projectiles as well. Throughout the present disclosure and continuances and/or divisional disclosures thereof, the terms 'slug,' 'bullet,' and 'projectile' may be used interchangeably to define a mass expelled from a firearm, usually explosively. The term 'nominal' used throughout may define a measurement or a metric near a mean in a normal distribution. Additionally, the terms, 'slot,' 'slit,' and 'vent' may be used interchangeably to define an opening through the cylindrical wall of the projectile for an escape of air short of complete passage through the hollow tube and thus improve the aerodynamics of the slug or bullet. Furthermore, the terms 'launch cup,' or 'sabot' may define a shoe or a receptacle for the bullet or slug which facilitates the explosive propulsion of the bullet or slug but falls away as it leaves the barrel of a firearm. The term 'cartridge' refers to a round or a shell and is a type of ammunition packaging a bullet or shot and a propellant within a metallic, paper, or plastic case that is precisely made to fit within the firing chamber of a firearm. The term 'annular' refers to a circular and generally ring shaped object. The term 'airfoil' refers to the shape of a wing or blade as seen in longitudinal cross-section and that produces an aerodynamic lift force.

FIGS. 1 through 9 disclose a novel and unobvious hollow tube bullet or projectile, comprising projectile 100 and the launch cup 200. The hollow tube bullet is considered to be a sub-caliber projectile as its outside diameter is less than the bore diameter of the barrel. In this representation the rear portion of the hollow tube bullet resides conformally within the front portion of the launch cup. The exterior surface and features of the launch cup engage the interior surface or bore of the barrel when fired. In this depiction the hollow tube bullet and launch cup when mated together would be loaded into a shotgun shell for firing from a conventional shotgun barrel.

FIG. 1 depicts a top elevational view of a hollow tube projectile and a cross-section A-A through a plurality of slots therein in accordance with an embodiment of the present disclosure. An exterior top view of the projectile 100 as depicted comprises a hollow metal tube with a nominally uniform cylindrical exterior profile and evenly spaced vents or slots 110. In this representation there are four slots which project completely through the wall of the metal tube. Section A-A is a right-angle cross-sectional view through slots 110. The number of slots could be greater than or less than four and is not therefore a limitation in this disclosure. Radial cross-hatching between slots indicates cross-sectional areas.

The hollow tube projectile and launch cup system is configured with a leading end to first exit a firearm barrel and a trailing end to follow there through as disclosed herein. The hollow tube projectile and launch cup system comprises a cylindrical hollow tube projectile with an inwardly chamfered leading end and a plurality of elongate vents spaced evenly around a nominally uniform cylindrical wall. The elongate vents are configured to have a semicircular leading edge and a nominally elliptical trailing edge. The trailing edge is configured to extend at an acute angle from an inner perimeter of the uniformly cylindrical wall to an outer perimeter thereof. An embodiment of the disclosure may include the trailing edge of each elongate vent extending a nominal 3.56 millimeters (0.14 inches), plus or minus ten percent, from the inner perimeter of the uniformly cylindrical wall to the outer perimeter thereof.

Figure 2:
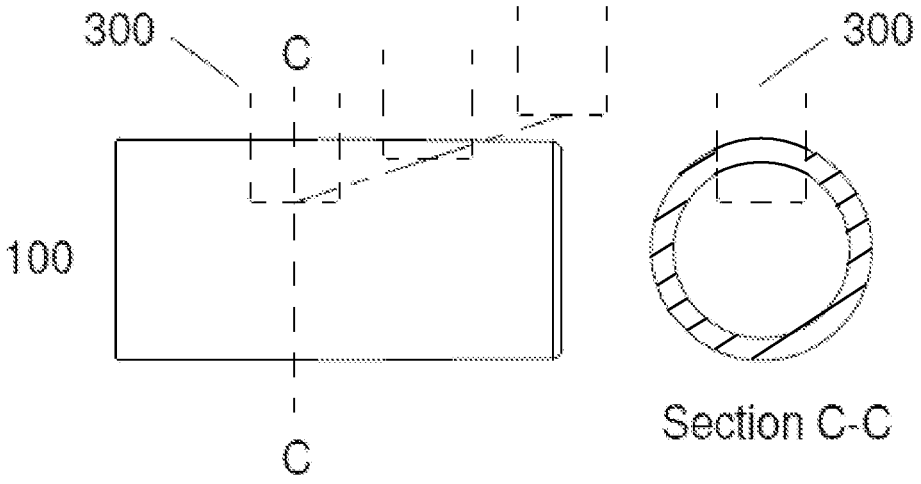
FIG. 2 depicts a side elevational view of a hollow tube slug and a cross-section C-C indicating a machine tool slot cut in accordance with an embodiment of the present disclosure.

FIG. 2 depicts a side elevational view of a hollow tube slug and a cross-section C-C indicating a machine tool slot cut in accordance with an embodiment of the present disclosure. An end mill machining tool 300 and its path are shown in phantom. The tool and path are used to create the various slots 110, in the tube material. Section C-C is a right angle section view through the tube and the machining tool, Item 300, at its point of entry and full penetration depth.

In embodiments of the disclosure, the leading edge of each elongate vent may be configured to be semicircular and extend at a right angle from an inner perimeter of the uniformly cylindrical wall to the outer perimeter thereof. The trailing edge of each elongate vent may be configured to be nominally elliptical. Additionally, adjacent elongate vents may be configured at a staggered length from the leading end of the hollow tube projectile to provide egress paths of various lengths for air escape from an interior of the hollow tube projectile at lower velocities and at higher velocities without traveling the full length of the hollow tube projectile.

Figure 3:
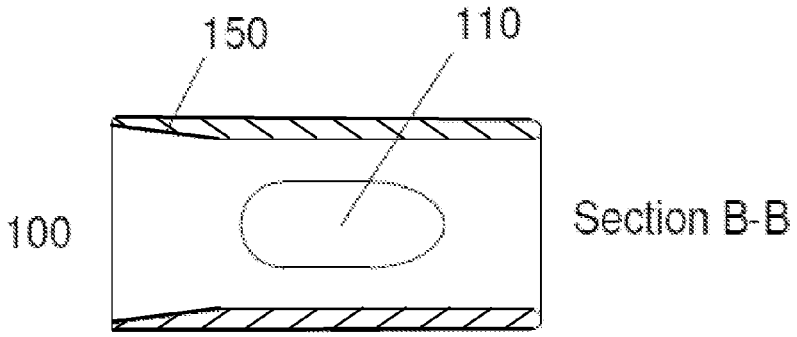
FIG. 3 depicts a longitudinal cross sectional view B-B from FIG. 1 to taken lengthwise through the hollow tube projectile of FIG. 1 in accordance with an embodiment of the present disclosure.

FIG. 3 depicts a longitudinal cross sectional view B-B from FIG. 1 taken lengthwise through the hollow tube projectile of FIG. 1 in accordance with an embodiment of the present disclosure. Section B-B, taken down the major centerline axis reveals the interior shape of slots 110. Also seen is the interior throat, Item 150, which has been machine tapered into the material thickness from leading back toward to the slots 110.

An embodiment may include a vent opening width configured to be in a range from a nominal 6.35 millimeters (0.250 inches) to a nominal 9.53 millimeters (0.38 inches) plus or minus a ten percent manufacturing tolerance.

Also, the trailing end of the hollow tube projectile may be configured to be rounded or tapered and any other finishing geometry suitable to aerodynamic advantage to avoid eddy currents and voids which hinder the movement of the projectile through the air and/or through fluids. The chamfered front end may be configured to extend a nominal 8.13 millimeters (0.32 inches), plus or minus ten percent, from a butt end portion at an acute angle to an inner perimeter of the uniformly cylindrical wall. Furthermore, a taper on an anterior portion of the hollow tube projectile may be configured for ease of insertion into a launch cup and ease of separation therefrom after leaving a barrel of a firearm.

Figure 4:
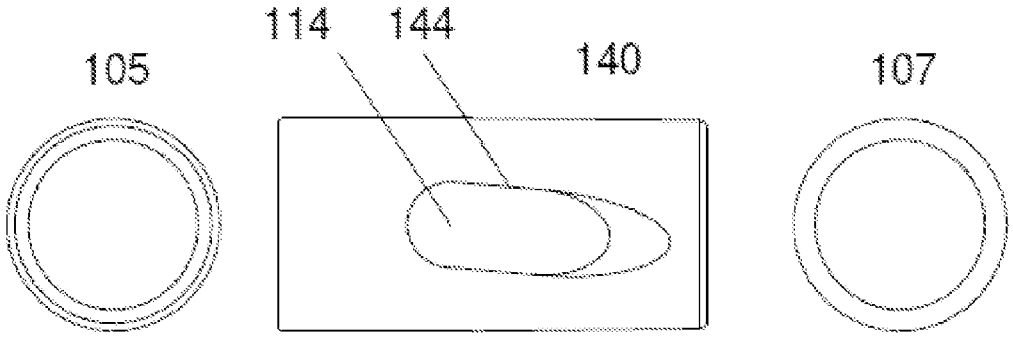
FIG. 4 depicts a top elevational view of a hollow tube projectile with an offset slot in accordance with an embodiment of the present disclosure.

FIG. 4 depicts a top elevational view of a hollow tube projectile with an offset slot in accordance with an embodiment of the present disclosure. A front elevational view 105 depicts the butt end, the taper and the throat of the hollow tube projectile 140. A back elevational view 107 depicts the finished trailing end of the hollow tube projectile 140. One difference between projectile 100, and projectile 140, are the offset slots 114. The offset slots are machined in the same manner as depicted in FIG. 2 but with the tool path being rotated clockwise with respect to the longitudinal axis a nominal 5 degrees.

Slots 114 generate a shallow fletching-like angle relative to the major centerline axis of the projectile, Item 140. Slots, Item 114, cause the exiting air to bear against the material thickness wall, Item 144, imparting a torque or rotating force as the air flows through the center of the tube and exits through the slots, Item 114. This airflow path will cause auto-rotation of the projectile, Item 140, without the need for conventional rifling. Item 105 the front end view of hollow tube projectile Item 100 or Item 140. Item 107 is the rear end view of hollow tube projectile Item 100 or Item 140.

In other words, the elongate vents may be configured parallel with an elongate axis of the hollow tube projectile or they may be configured offset from an elongate axis of the hollow tube projectile. An offset axis thereof imparts auto-rotation to the hollow tube projectile in flight and thus may stabilize the projectile through gyroscopic forces thereon. An outer diameter of the hollow tube projectile nominally measures 15.88 millimeters (0.625 inches) plus or minus a ten percent manufacturing tolerance. Also, the disclosed hollow tube projectile may comprise a nominally uniform diameter from the leading end to the trailing end thereof.

Figure 5:
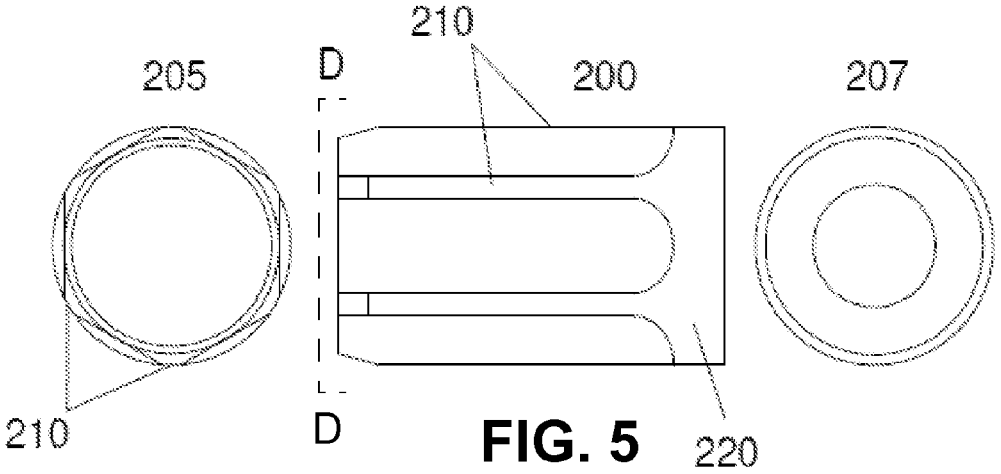
FIG. 5 depicts a side elevational view of a hexagonal launch cup with a chamfered front end and a circular back end in accordance with an embodiment of the present disclosure.

FIG. 5 depicts a side elevational view of a hexagonal sabot with a chamfered front end and a circular back end in accordance with an embodiment of the present disclosure. The launch cup or also known as a sabot, Item 200, may be to comprised of machined or injection molded plastic material or a composite thereof. Item 210 is depicted with six exterior ribs that would engage bore of the barrel when fired. The exterior surface of ribs 210 commence near the leading edge of Item 200 and continue back and blend into the anterior skirt, Item 220. The exterior surfaces of Item 210 and Item 220 both have the same diameter for engaging the bore of the firearm barrel.

The disclosed launch cup comprises an outwardly chamfered leading end and a plurality of elongate exterior ribs spaced evenly around an otherwise cylindrical wall. The ribs are configured to extend longitudinally from the leading end toward the trailing end and blend into an anterior skirt on the trailing end. The trailing end is configured in a receptacle aft and the leading end is configured in a receptacle fore to receive the hollow tube projectile therein.

A front elevational view 205 of the launch cup 200 depict exterior ribs 210 configured to form a plurality of arc segments comprising a radius equivalent to a radius of the anterior skirt to engage a bore of a firearm barrel. A rear elevational view 207 of the launch cup 200 shows an inward taper from a peripheral edge thereof to inter alia facilitate injection molding draw. A taper on the injection molded receptacle fore also facilitates the insertion and separation of the hollow tube projectile from the launch cup as further explained below.

Figure 6:
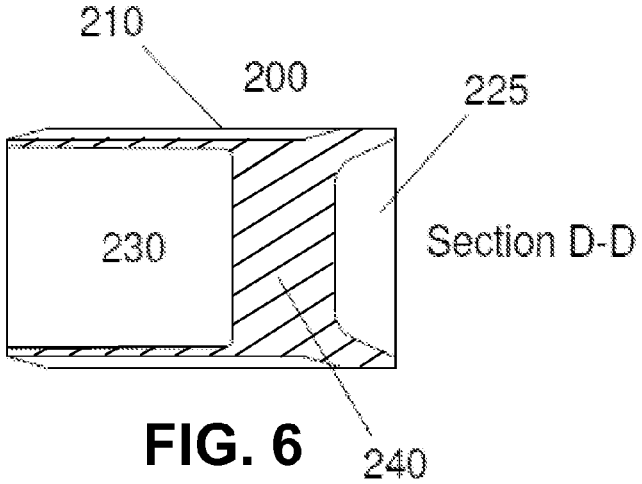
FIG. 6 depicts a longitudinal cross sectional view D-D from FIG. 5 taken lengthwise through the launch cup of FIG. 5 in accordance with an embodiment of the present disclosure.

FIG. 6 depicts a longitudinal cross sectional view D-D from FIG. 5 taken lengthwise through the launch cup of FIG. 5 in accordance with an embodiment of the present disclosure. The longitudinal view, Section D-D, down the major centerline axis of Item 200 reveals the interior shape of launch cup, Item 200. Item 230 is the anterior receptacle for receiving the posterior exterior portion of Item 100 in conformal relationship when fitted together. Item 240 is the solid interior floor underneath Item 230. Item 225 is the posterior receptacle aft of Item 240. The projectile launch cup further comprises a solid interior floor 240 between the receptacle fore of the leading end and the receptacle aft of the trailing end.

Figure 7:
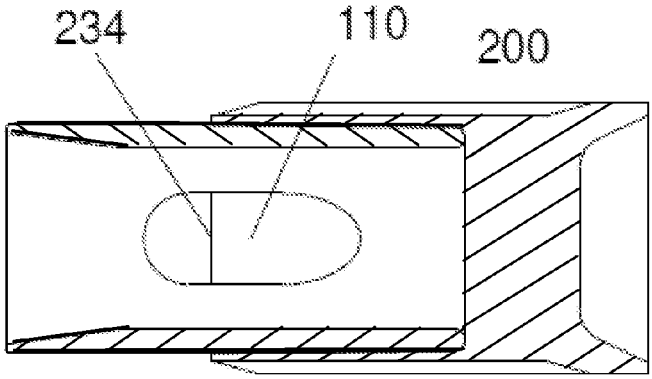
FIG. 7 is a combined longitudinal cross sectional view of FIG. 3.

FIG. 7 is a combined longitudinal cross sectional view of FIG. 3 and FIG. 6 of the hollow tube projectile of FIG. 3 in the launch cup of FIG. 6 in accordance with an embodiment of the present disclosure. The combined sectional view of Item 100 from FIG. 3 in conformal relationship with the sectional view of Item 200 from FIG. 6. Item 234 is a portion of the interior leading edge of to Item 230 as seen through the interior view of slot, Item 110.

Therefore, the leading end of the hollow tube projectile is adjacent to the leading end of the launch cup and the trailing end of the hollow tube projectile is adjacent to the trailing end of the launch cup in an embodiment of the disclosure. Also, a portion of the leading end of the launch cup may therefore be visible through an elongate vent of the hollow tube projectile as depicted.

Figure 8:
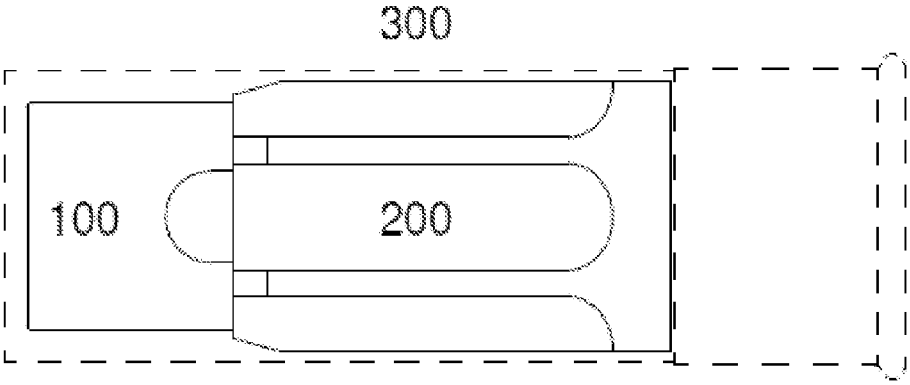
FIG. 8 depicts a side elevational view of the hollow tube projectile of FIG. 1 inside the launch cup of FIG. 5 loaded within a shotgun shell in broken lines in accordance with an embodiment of the present disclosure.

FIG. 8 depicts a side elevational view of the hollow tube projectile of FIG. 1 inside the launch cup of FIG. 5 loaded within a shotgun shell in broken lines in accordance with an embodiment of the present disclosure. The depicted view of the combined projectile, Item 100, fitted together with launch cup, Item 200, and loaded within a conventional shotgun shell, Item 300, shown in phantom.

Figure 9:
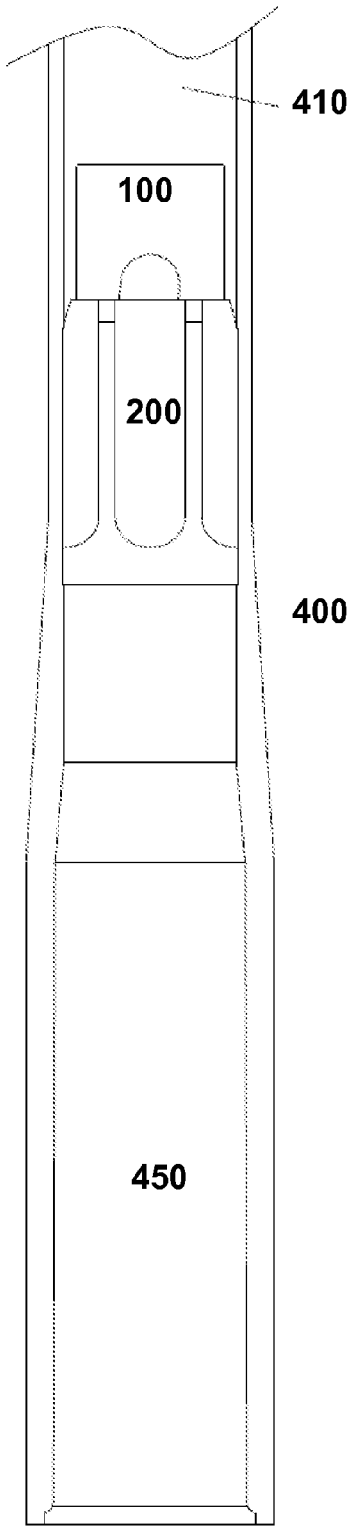
FIG. 9 depicts a portion of a shotgun barrel with a loaded shotgun shell comprising the hollow tube projectile and the launch cup in accordance with an embodiment of the present disclosure.

FIG. 9 depicts a portion of a shotgun barrel with a loaded shotgun shell comprising the hollow tube projectile and the launch cup in accordance with an embodiment of the present disclosure. The depicted portion of a shotgun barrel, Item 400, includes the chamber portion, Item 450, into which a loaded shogun shell, Item 300, would reside for firing. Also depicted are Item 100 and Item 200 in conformal relationship immediately after firing from the shotgun shell and within the bore of the barrel, Item 410. It can be readily seen that the diameter of projectile, Item 100, is less than the bore diameter, Item 410 and the exterior dimension of Item 200 is essentially the same and in intimate contact with Item 410.

Upon exiting the barrel, Item 400, the projectile, Item 100, will separate from the launch cup, Item 200, as the air passing into Item 105, and through the back of the projectile, Item 107, and through slots, Item 110, will retard the velocity of Item 200 to a far greater degree than Item 100.

Among the weapons that could use the projectiles described herein are common shotguns. Although not required or specified, the nominal outside diameter for the projectiles depicted is approximately .625 inches. These projectile variants are designed to fit within every day shot gun shells and used in smooth or rifled barrel shotguns. The hollow tube projectiles described herein could be made from readily available metal tube on Computer Numerically Controlled machining centers or various other means common to industry.

FIGS. 10 through 14 depict another novel and unobvious hollow tube projectile or bullet including the projectile 1000 also known as HTS12™ and the launch wafer 1100. In this embodiment, the hollow tube projectile 1000 is considered to be a full caliber projectile as its outer diameter is nominally equal to the bore of a firearm barrel. In this representation the rear portion of the projectile resides upon the launch wafer while unfired in the shotgun shell and is pushed down the barrel by the launch wafer when the shell has been fired. The exterior diameter of the launch wafer is nominally equal to the bore of the barrel as well. One effect of an annular lifting force created by the engineered design of the disclosure is to stabilize the projectile against errant atmospheric forces against gravity and flight droop.

Figure 10:
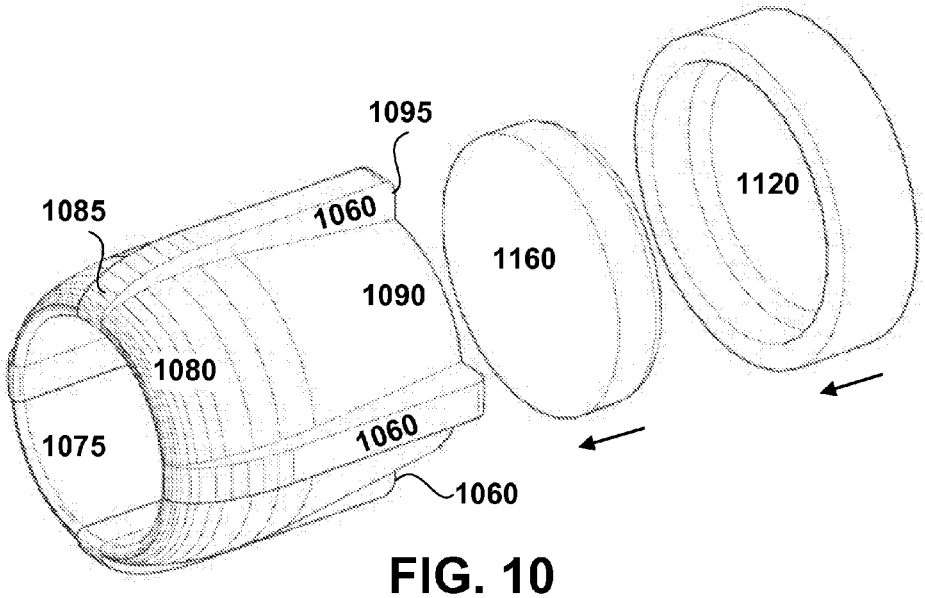
FIG. 10 depicts a three dimensional view of the annular airfoil projectile with straight fins in accordance with an embodiment of the present disclosure.

FIG. 10 depicts a three dimensional view of the annular airfoil projectile with straight fins in accordance with an embodiment of the present disclosure. The hollow tube projectile 1000 is configured with a leading edge 1080 to first exit a firearm barrel and a trailing edge 1090 to follow there through, the hollow tube projectile 1000 comprising an annular airfoil body. Three or more fins 1060 are distributed equidistantly around the airfoil body, wherein each fin 1060 has an inner edge complementary to the outer lifting surface of the body and an outer edge nominally parallel to a major axis through the projectile 1000. Each fin 1060 may also comprise a leading edge 1085 and a trailing edge 1095. A longitudinal cross section through the annular airfoil body resembles an airplane wing having a rounded leading edge and a sharp trailing edge and an outer lifting surface there around and an inner cylindrical surface. The inner cylindrical surface is at a higher pressure than the outer lifting surface.

A hollow tube cartridge includes the projectile 1000 and a launch wafer cup 1120 and a metal insert 1160 adapted to contain combustion gases during a launch of the annular airfoil body or slug. The launch wafer cup 1120 is adapted to receive the metal insert 1160 and concentrically position itself within the hollow tube cartridge. The single line straight arrows indicate an assembly of the launch wafer cup 1120 and the metal insert 1160 to be mated with the projectile 1000 sometime prior to launch of the projectile. The inner cylindrical surface 1075 may comprise a chordal surface that connects the leading edge 1080 and the trailing edge 1090 of the hollow tube projectile 1000.

Figure 11:
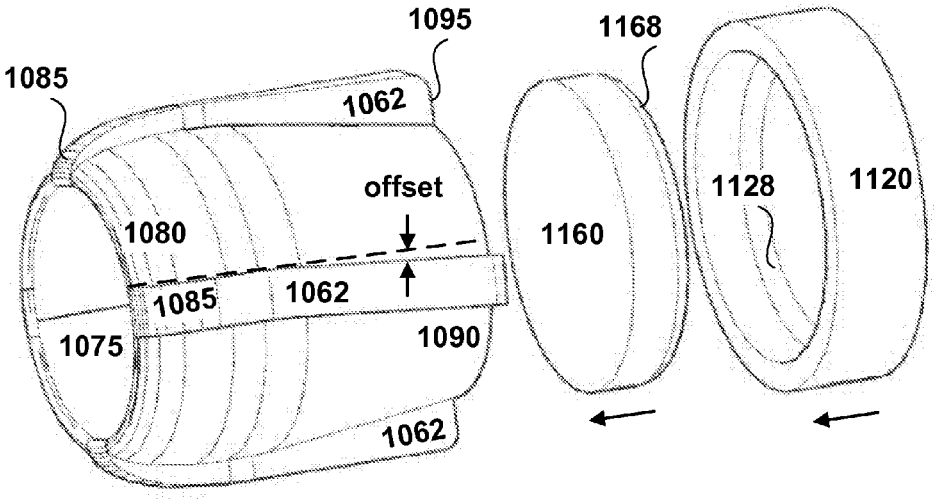
FIG. 11 depicts a three dimensional view of the annular airfoil projectile with a portion of the fins offset in accordance with an embodiment of the present disclosure.

FIG. 11 depicts a three dimensional view of the annular airfoil projectile with a portion of the fins offset in accordance with an embodiment of the present disclosure. The depicted embodiment includes many of the features and characteristics of the projectile and cartridge of the previous figure and therefore many of the same reference numbers may be repeated. However, a portion of the fins 1062 are offset from the disclosed straight fin design in order to impart an aerodynamic spin to the projectile in flight. Some or all of the fins may be offset from a straight fin design according to the amount of spin and number of revolutions desired in flight. The rotational spin is self-imparted when shot from a smooth bore barrel by having all or some trailing portion of the fins 1060 configured in a slightly angled manner similar to the fletching angle of an arrow's tail feathers.

Also, a chamfer 1128 may be formed on the inside pocket of the launch wafer cup 1120 to facilitate manufacturing of the wafer and also to receive the metal insert 1160. The metal insert 1160 may also include a chamfered edge 1168 complementary to the launch wafer cup chamfer 1128.

Figure 12:
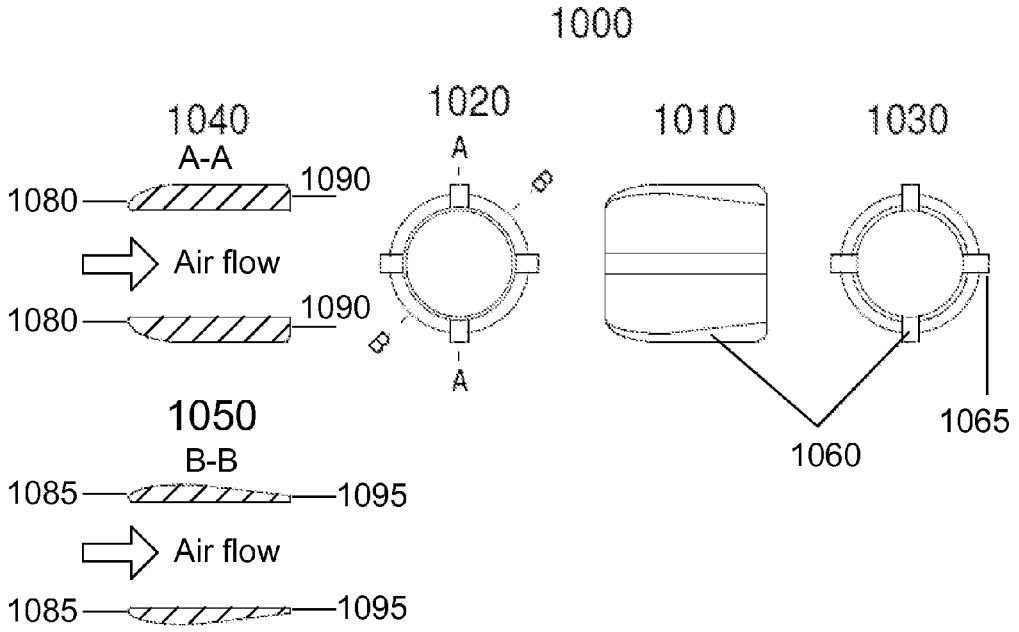
FIG. 12 depicts various views of the projectile, including a front end view, a side view, a rear end view, a sectional view A-A and a sectional view B-B in accordance with an embodiment of the present disclosure.

FIG. 12 depicts various views of the projectile 1000, including a front end view 1020, side view 1010, rear end view 1030, sectional view A-A (down the major axis 1040) and additional section view B-B (down the major axis 1050 but rotated 45 degrees off vertical) in accordance with an embodiment of the present disclosure. This representation depicts a projectile with four fins 1060, which come in to contact with the inside diameter or bore as the projectile 1000 moves down the barrel. The projectile can be configured with three or more fins 1060 that stabilize the projectile and maintain a concentric relationship with the barrel when fired and engage the air upon leaving barrel. The contact surfaces of the fins 1065 in this depiction are arc segments with an outside diameter equal to or slightly greater than the bore diameter.

The sectional view 1040 illustrates the wing like profile the air will encounter as it passes around the fins 1060. The fins 1060 in this depiction are shown to be straight and parallel with the major axis of the projectile 1000. The fins include a leading edge 1080 and a trailing edge 1090. The hollow tube projectile may further comprise a zero angle of attack between an airflow incident on the annular airfoil body and a chord line connecting the leading edge and the trailing edge of the hollow tube projectile.

The sectional view 1050 illustrates the wing like profile the air will encounter as it passes between the fins 1060 over the annular body. An outer edge of each fin may be chamfered. The fins include a leading edge 1085 and a trailing edge 1095.

When fired through a rifled barrel, the fins 1060 are engaged by the lands and grooves of the rifling and a rotational spin is imparted to the projectile 1000. Due to this rotational spin and the wing like profile between the fins 1060, aerodynamic lift can be generated in what is known as a ring airfoil effect.

Another embodiment of the hollow tube projectile may comprise a ratio of a maximum thickness of the fins to a maximum thickness of the annular airfoil body is 3.0 parts to 2.0 parts respectively. Also, the hollow tube projectile may include a ratio of a lateral width of each fin in relation to a maximum thickness thereof is 1.5 parts to 2.0 parts respectively. Furthermore, the hollow tube projectile may include a ratio of an outside diameter of the hollow tube projectile comprising the outer edges of the fins to a length of the hollow tube projectile is 1.0 parts to 1.0 parts respectively.

A further embodiment of the hollow tube firearm or projectile may include three or more fins including 4 fins, 5 fins and 6 fins arranged in a three point, a four point, a five point and a 6 point star-like cross-section. A leading edge of each fin may be aerodynamically tapered toward a trailing edge of each fin along a portion of a length of each fin. Additionally, a trailing edge of each fin and a trailing edge of the annular airfoil bullet may be blunt and adapted to enable the metal insert to explosively push the annular airfoil bullet through a firearm barrel.

Figure 13:
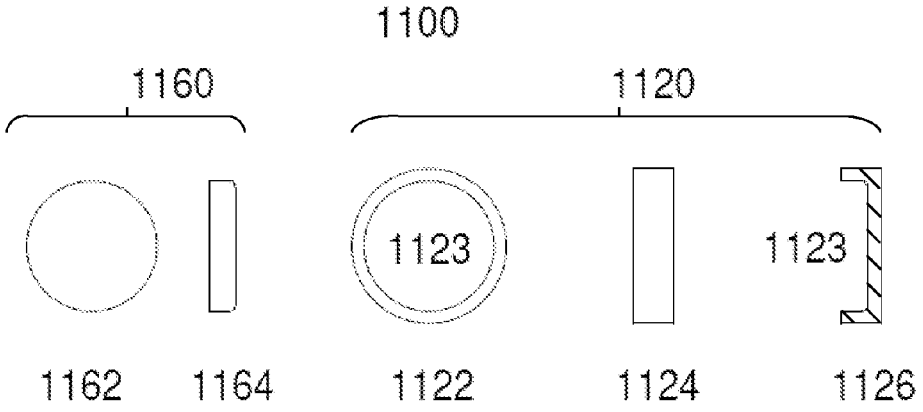
FIG. 13 depicts the launch wafer and its two constituent pieces in accordance with an embodiment of the present disclosure.

FIG. 13 depicts the launch wafer 1100 and its two constituent pieces in accordance with an embodiment of the present disclosure. In this representation the launch wafer is comprised of a polymer wafer cup 1120 and a metal insert 1160, which resides within the polymer wafer cup when in use. The metal insert 1160 may also be discoid. The end view 1122 of the polymer wafer cup illustrates a circular pocket 1123 that substantially receives the metal insert 1160. The thickness of the metal insert shown in the side view 1164 is substantially the same as the depth of the pocket 1123 as shown in the cross sectional view 1126 of the polymer wafer. A side view 1124 of the polymer wafer cup 1120 also depicts its relative thickness in relation to its diameter. A relative diameter and a relative thickness of the metal insert are illustrated by 1162 and 1164 respectively. The diameter of the metal insert as shown in the end view 1162 is slightly smaller than the pocket 1123 as shown in the end view 1122 of the polymer wafer. The outside diameter of the assembled launch wafer 1100 is nominally the same as the outside diameter of the hollow tube projectile 1000. The outside diameter of the metal insert 1160 is somewhat larger than the inside diameter of the hollow tube projectile 1000. The metal insert provides mechanical strength greater than the polymer alone and prevents the combustion gases from blowing through the inside diameter of the hollow tube projectile 1000.

An embodiment of the launch wafer comprises a polymer and any high durometer material and any heat resistant material and any extrudable material and any injection molded material and any combination thereof.

Figure 14:
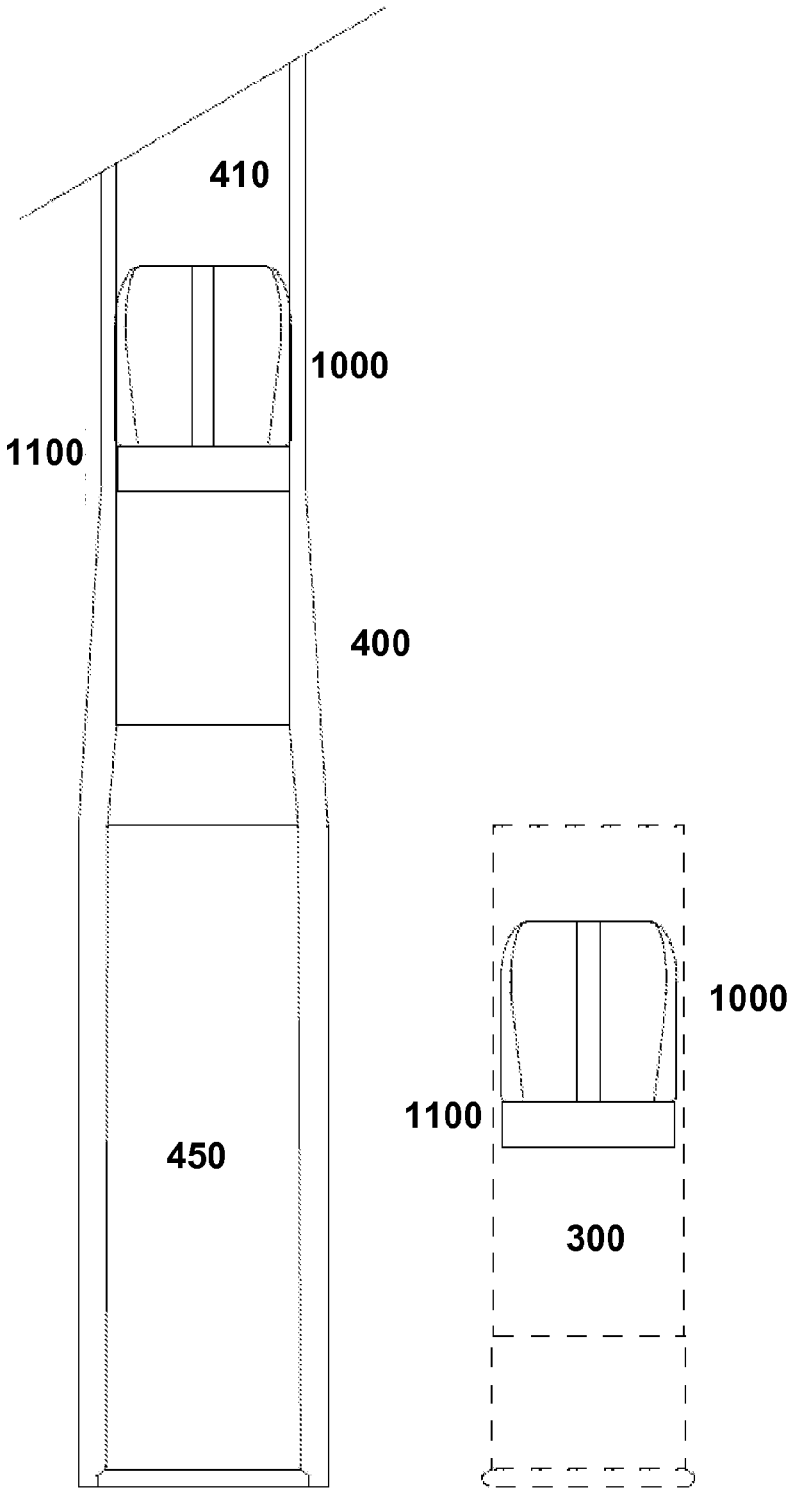
FIG. 14 shows a side elevation view of the hollow tube projectile to and the launch wafer loaded within a conventional shotgun shell and immediately after being fired in accordance with an embodiment of the present disclosure.

FIG. 14 shows a side elevation view of the hollow tube projectile 1000 and the launch wafer 1100 loaded within a conventional shotgun shell, Item 300 (shown in phantom with broken lines) and immediately after being fired in accordance with an embodiment of the present disclosure. The launch wafer resides between the gun powder charge and the hollow tube projectile 1000. FIG. 14 also depicts a portion of a conventional shotgun barrel, Item 400, the shotgun barrel chamber, Item 450, the barrel bore, Item 410 and the hollow tube projectile, Item 1000, with the launch wafer, Item 1100, within the barrel bore immediately after leaving the shotgun shell.

Upon exiting the barrel, the hollow tube projectile, Item 1000, will separate from the launch wafer, Item 1100, as the air passes through the inside diameter of the hollow tube projectile and bears against the launch wafer.

An embodiment of the hollow tube projectile may further include a launch device formed with a portion adapted to fit within the annular airfoil bullet and a portion adapted to provide a launch surface for the annular airfoil bullet. The launch device may comprise a single piece formed into a plug with a cap portion for the launch surface or the launch device may comprise separate and discrete pieces or components for the plug and the cap according to manufacturing to constraints and/or costs.

Although the components herein are shown and described in a particular order, the order thereof may be altered so that certain advantages or characteristics may be optimized In another embodiment, instructions or sub-operations of distinct steps may be implemented in an intermittent and/or alternating manner.

Notwithstanding specific embodiments of the invention have been described and illustrated, the invention is not to be limited to the specific forms or arrangements of parts so described and illustrated. The scope of the invention is to be defined by the claims and their equivalents.

What is claimed is:

1. A hollow tube projectile configured with a leading edge to first exit a firearm barrel and a trailing edge to follow there through, the hollow tube projectile comprising:

an annular airfoil body, a longitudinal cross section thereof resembling an airplane wing having a rounded leading edge and a sharp trailing edge and an outer lifting surface there around and an inner cylindrical surface; and a plurality of three or more fins distributed equidistantly around the annular airfoil body, each fin having an inner edge complementary to the outer lifting surface of the body and an outer edge parallel to a major axis through the hollow tube projectile.

2. The hollow tube projectile of claim 1, further comprising a zero angle of attack between an airflow incident on the annular airfoil body and a chordal surface connecting the leading edge and the trailing edge of the hollow tube projectile.

3. The hollow tube projectile of claim 1, wherein the fins form a plurality of arc segments with an outside diameter nominally equal to or nominally greater than a bore diameter of a firearm barrel.

4. The hollow tube projectile of claim 1, wherein at least a portion of the fins are configured to be offset from the major axis of the projectile, the offset fins configured to impart an aerodynamic spin to the hollow tube projectile in flight.

5. The hollow tube projectile of claim 1, wherein the fins are formed in-line with the major axis of the hollow tube projectile, the in-line fins configured to concentrically position the hollow tube projectile in a barrel of a gun and aerodynamically stabilize the hollow tube projectile in flight.

6. The hollow tube projectile of claim 1, wherein a ratio of a maximum thickness of the fins to a maximum thickness of the annular airfoil body is 3.0 parts to 2.0 parts respectively.

7. The hollow tube projectile of claim 1, wherein a ratio of a lateral width of each fin in relation to a maximum thickness thereof is 1.5 parts to 2.0 parts respectively.

8. The hollow tube projectile of claim 1, wherein a ratio of an outside diameter of the hollow tube projectile comprising the outer edges of the fins to a length of the hollow tube projectile is 1.0 parts to 1.0 parts respectively.

9. A hollow tube projectile configured with a leading edge to first exit a firearm barrel and a trailing edge to follow there through, the hollow tube projectile comprising:

an annular airfoil slug, a cross section thereof resembling an airplane wing having a rounded leading edge and a sharp trailing edge and an outer lifting surface there around and an inner pressure surface;

a plurality of three or more fins distributed equidistantly around the annular airfoil slug, each fin having an inner edge complementary to the outer lifting surface of the annular airfoil slug and an outer edge parallel to a major axis through the annular airfoil slug; and a launch wafer adapted to contain combustion gases during a launch of the annular airfoil slug, the launch wafer also adapted to concentrically position the annular airfoil slug within a hollow tube cartridge.

10. The hollow tube projectile of claim 9, wherein the launch wafer comprises a metal insert and a cup adapted to receive the metal insert and concentrically position it adjacent the annular airfoil slug within the hollow tube cartridge.

11. The hollow tube projectile of claim 9, further comprising a metal insert received in the launch wafer, wherein an outside diameter of the metal insert is nominally larger than an inside diameter of the annular airfoil slug.

12. The hollow tube projectile of claim 9, wherein the launch wafer comprises a polymer and any high durometer material and any heat resistant material and any extrudable material and any injection molded material and any combination thereof.

13. The hollow tube projectile of claim 9, wherein the launch wafer is adapted to separate from the annular airfoil slug upon leaving a barrel of a firearm based on an airflow through the annular airfoil slug against the launch wafer.

14. A hollow tube projectile configured with a leading edge to first exit a firearm barrel and a trailing edge to follow there through, the hollow tube projectile comprising:

an annular airfoil bullet, a cross section thereof resembling an airplane wing having a rounded leading edge and a sharp trailing edge and an outer lifting surface there around and an inner pressure surface;

a plurality of three or more fins distributed equidistantly around the annular airfoil bullet, each fin having an inner edge complementary to the outer lifting surface of the slug and an outer edge parallel to a major axis through the annular airfoil bullet; and a launch device adapted to contain combustion gases during a launch of the annular airfoil bullet and be positioned adjacent thereto, the launch device also adapted to position the annular airfoil bullet concentrically within a bore of the firearm barrel.

15. The hollow tube projectile of claim 14, wherein the launch device comprises a portion adapted to fit within the annular airfoil bullet and a portion adapted to provide a launch surface for the annular airfoil bullet.

16. The hollow tube projectile of claim 14, wherein each fin comprises an outer edge adapted to engage the lands and grooves of a firearm barrel.

17. The hollow tube projectile of claim 14, wherein the plurality of three or more fins comprises 4 fins, 5 fins and 6 fins arranged in a three point, a four point, a five point and a 6 point star-like cross-section.

18. The hollow tube projectile of claim 14, wherein a leading edge of each fin is aerodynamically tapered toward a trailing edge of each fin along a portion of a length of each fin.

19. The hollow tube projectile of claim 14, wherein a trailing edge of each fin and a trailing edge of the annular airfoil bullet are blunt and adapted to enable the metal insert to explosively push the annular airfoil bullet through a firearm barrel.

20. The hollow tube projectile of claim 14, wherein the launch device is positioned between a gun powder charge in the firearm and the annular airfoil bullet.

* * * * *